United States Patent [19]

Seidl et al.

[11] 4,244,705

[45] Jan. 13, 1981

[54] TRIPLE ROTARY GAS LOCK SEAL SYSTEM FOR TRANSFERRING COAL CONTINUOUSLY INTO, OR ASH OUT OF, A PRESSURIZED PROCESS VESSEL

[75] Inventors: Robert M. Seidl, Greendale; Francis J. Enright, Milwaukee, both of Wis.

[73] Assignee: Allis-Chalmers Corporation, Milwaukee, Wis.

[21] Appl. No.: 42,041

[22] Filed: May 24, 1979

[51] Int. Cl.[3] ..... C10J 3/68

[52] U.S. Cl. ..... 48/77; 48/86 R; 110/108; 202/262; 414/219

[58] Field of Search ..... 48/86 R, 77; 202/269, 202/262; 414/221, 195, 211, 200, 158, 216, 219, 220; 110/327, 108, 110, 118, 276; 222/252, 254, 368

[56] References Cited

U.S. PATENT DOCUMENTS

| | | | |
|---|---|---|---|
| 2,347,271 | 4/1944 | Linn | 222/252 |
| 2,585,472 | 2/1952 | Kennedy | 414/220 |
| 2,599,978 | 6/1952 | Davis et al. | 222/368 |
| 3,347,741 | 10/1976 | Hutchison | 414/221 |
| 4,049,394 | 9/1977 | Gernhardt et al. | 48/86 R |

FOREIGN PATENT DOCUMENTS

| | | | |
|---|---|---|---|
| 1054199 | 4/1959 | Fed. Rep. of Germany | 48/86 R |

*Primary Examiner*—S. Leon Bashore
*Assistant Examiner*—Michael Goldman
*Attorney, Agent, or Firm*—Robert C. Jones

[57] ABSTRACT

A multiple rotary gas lock apparatus using a buffer seal gas is disclosed to enable the transfer of solid materials into or out of a pressurized process containing high temperature, flammable or toxic gases. The buffer seal gas, has a pressure higher than the process pressure and is introduced between two series connected gas locks; this prevents process gas backflow to the feed system. Buffer seal leakage gas from the first pair of gas locks and air from a third gas lock are removed from an opening in a connection between the pair of gas locks and the third gas lock at subatmospheric pressure. This system enables control and usuage of toxic or flammable gases as a buffer for mixing compatibility with the process gas when a suitable inert gas is not available. It also prevents the flow of any toxic gas to the worker environment.

6 Claims, 1 Drawing Figure

TRIPLE ROTARY GAS LOCK SEAL SYSTEM FOR TRANSFERRING COAL CONTINUOUSLY INTO, OR ASH OUT OF, A PRESSURIZED PROCESS VESSEL

BACKGROUND OF THE INVENTION

The present invention relates to rotary gas locks utilized for transfer of coal into or ash out of an enclosed system, either pressure or vacuum, for which exchange of gases internal to the system with those external to the system is not desirable or permitted. The rotary gas lock is used as means for transferring the aforementioned material into of out of pressurized or vacuum system to minimize gas leakage. A toxic buffer gas may be used as a sealing barrier in this invention; if toxic gas is used as a sealing barrier, the toxic buffer gas will also be prevented from being released into the ambient atmosphere externally to the system. Prior art has disclosed the use of a rotary gas lock in conjunction with air,-steam and other types of gases which are nontoxic and nonflammable and restrictive in pressure differential capabilities to a single rotary gas lock.

The general object of this invention is to transfer coal into, or ash out of pressurized processes having high temperature, flammable, toxic and contaminant-laden gases.

An object of the present invention is to eliminate the constraints associated with a single-stage rotary gas lock in a material transfer system.

Another object of this invention is to provide a new and novel arrangement of a multiple rotary gas lock and buffer-gas seal system for coal-feed or ash discharge into or out of a pressurized process, respectively.

SUMMARY OF THE INVENTION

Triple rotary gas locks with a buffer gas provide a seal for a continuous pressurized coal gasification process involving relatively high temperatures. The seal, prevents the escape of hazardous gases from the pressurized system. Three rotary gas locks are connected in a series relationship through which coal, is directed into the feed end of a rotary kiln for conversion of the coal to process or fuel gases. The unconsumed material, ash flows out of the rotary kiln and thence through discharge rotary gas locks with a buffer-gas seal system to prevent gases escaping from the discharge end of the system.

DESCRIPTION OF THE INVENTION

Figure 1:
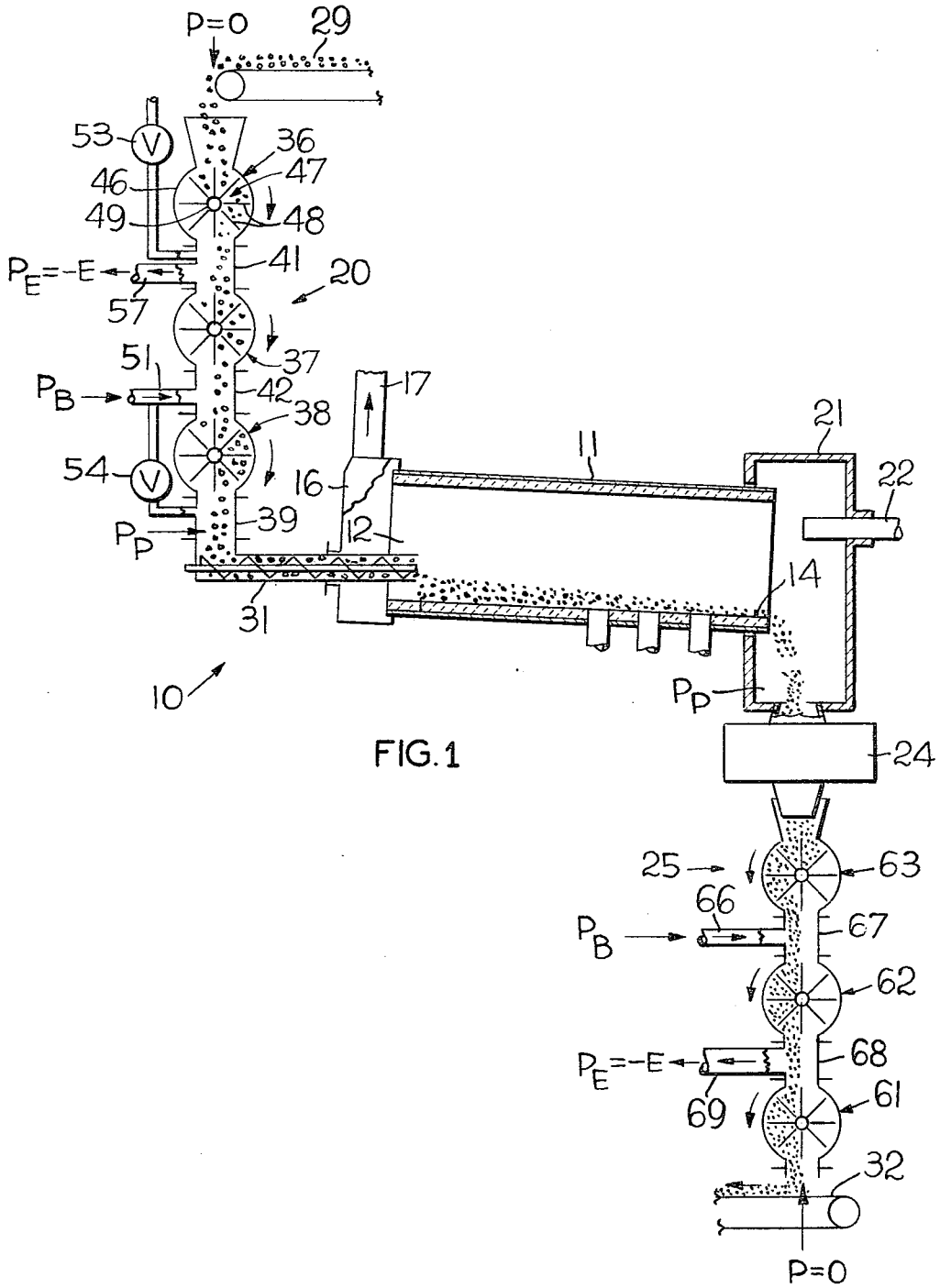
FIG. 1 is a diagrammatic view in section of the present invention showing a process system utilizing rotary gas locks with buffer-gas seals at the feed and discharge ends of the process system.

Referring to FIG. 1, there is shown a gasification process system 10 which operates to effect the conversion of bulk coal materials for obtaining desired process or fuel gases. The invention herein disclosed is shown in conjunction with a bulk material transfer system for a gasification process but is not intended to be limited in scope to a particular type of pressurized process system. A buffer gas is used to prevent undesirable flow of process gas out of the system or external gas into the system. In other words, buffer gas is utililzed as a barrier. The process system 10 includes an inclined rotary kiln 11 having a material inlet end 12 and an outlet end

14 through which ash is discharged. The inlet end 12 of the kiln is provided with a gas collecting hood 16 which encloses the inlet end. Process gases exit from the kiln 11 into the collector 16 and then flow through a connected duct 17 to a cleanup system (not shown) which operates or removes contaminants from the process gas. Bulk coal is supplied to the kiln 11 via an inlet rotary gas lock buffer-gas seal system 20.

The outlet end 14 of the kiln 11 is enclosed by a discharge hood 21 which is arranged to encompass the kiln end. Extending through the hood 21 is a retractable burner 22 which supplies the necessary start-up heat for the process. As shown, the hood 21 communicates with a cooler 24 which, in turn, communicates with a gas lock buffer-gas seal discharge system 25 which operates to prevent the escape of gases from the system.

The conversion of the fuel at the lower end of the kiln produces toxic and flammable gases, such as CO, $H_2S$, $H_2$, along with $CO_2$, $N_2$, water vapor and small quantities of other gases. These gases, at 2000° F., pass over and preheat the coal and then exit from the inlet and via the duct 17 at a relatively lower temperature.

The coal is supplied to the gasification process system 10 through the rotary gas lock buffer-gas seal system 20 connected to deliver the coal from a weigh feeder 29 to a screw conveyor device 31. Discharge of the ash from the gasification process system 10 is through a cooling system 24 and then through a discharge rotary gas lock buffer-gas seal system 25. From the discharge system 25 the ash is delivered to a conveyor 32 for ultimate disposal (not shown).

As shown in FIG. 1, the rotary gas lock system 20 includes three rotary gas locks 36, 37 and 38 connected in series relationship to the inlet of the screw conveyor 31 by a connecting duct 39. The discharge end of the rotary gas lock 36 is connected to the inlet of the rotary gas lock 37 by a duct 41. The outlet of rotary gas lock 37 is in communication with the inlet side of the gas lock 38 via a duct 42.

The rotary gas locks are commercially available units and are similar and in general comprise a hollow housing or shell 46. Within the housing 46 there is a rotor 47 having a plurality of spaced-apart radially extending blades or vanes 48 all secured to a drive shaft 49. The spacing between the blades or vanes 48 form pockets to which bulk coal, in a predetermined quantity, is supplied.

In FIG. 1, there are, in the order of progression, three rotary gas locks, with pressures at atmospheric air pressure [P=O]; exhaust pressure [$P_E = -E$] which corresponds to several inches of water subatmospheric; buffer seal gas pressure [$P_B$]; and the process pressure [$P_p$]. The bulk material flows consecutively through gas locks 36, 37 and 38 from an atmospheric pressure condition P=O to the process pressure [$P_p$]. Buffer seal gas at pressure [$P_B$] is introduced into a pressure pipe 51 which is connected to the high pressure duct 42. Some buffer seal gas, at a pressure slightly greater than the process gas pressure [$P_p$], leaks past the rotor of rotary gas lock 38 into the process. This prevents process gas flow back into the feed system. The remainder of the buffer seal gas leaks past the rotor and flows into the low pressure duct 41 through rotary gas lock 37. This buffer seal gas leakage is removed via the exhaust pipe 57 connected to the pressure duct 41 which has an internal pressure slightly below atmosphere [$P_E = -E$]. The air in-flow through gas lock 36 prevents leakage of the buffer seal gas through gas lock 36 into the area external to the gas lock.

For the rotary gas lock 36, provision is made for a modulated air flow valve 53 to admit air to the materials outlet side of the air lock 36 in duct 41 at a somewhat higher pressure than the gas which escapes into duct 41 from the gas lock 37 to replace the voids left by the falling coal solids. This can be more readily visualized if one assumes that the rotor to body clearance gap is essentially zero. Under this assumed condition, without bypass air compensation, the void left by the material solids must be replaced by a corresponding quantity of buffer seal gas through gas lock 37. The pockets of the gas lock, partially filled with buffer seal gas, then rotate to the inlet side of the gas lock 36. The incoming coal solids displaces a portion of a pocket gas mixture of air and buffer seal gas resulting in the escape of the buffer seal gas to the atmosphere. If the buffer seal gas is toxic or flammable, the above described leakage would be an unacceptable condition. Hence, the modulated air flow valve 53 operates to admit bypass compensation air in proportion to the coal materials' solids volume. The amount of bypass air to be admitted may be decreased by the amount of rotor to body gap clearance leakage.

Similarly a modulated gas flow valve 54 is provided for solid volumetric bypass compensation for gas lock 38. Backflow of the process gas, if contaminated or having high temperature, would generally be considered to be unacceptable.

The discharge rotary gas lock system 25 includes three rotary gas locks 61, 62 and 63, and are indicated in the same pressure level order as was described for the inlet rotary gas lock buffer-gas seal system 20, P=0 to process pressure, $P_p$.

As shown in FIG. 1, the rotary gas lock discharge system 25 is adapted to receive the discharge from the kiln 11 with the material flowing consecutively through gas locks 63, 62 and 61 from a process pressure condition $P_p$ to an atmospheric pressure condition, P=0. Buffer-seal gas at pressure $P_B$ is introduced into pressure pipe 66 connected to the high pressure duct 67. Some buffer seal gas, at a pressure slightly greater than the process gas $P_p$ leaks through the clearance gaps which exist between the rotor blades and the internal surface of the body shell into the process through gas lock 63. This prevents process gas flow into the system. The remainder of the buffer seal gas leaks past the rotor through the body clearance gaps into the lower pressure duct 68 through gas lock member 62. The buffer seal gas leakage is removed via the exhaust pipe 69 connected to the lower pressure duct 68 which has an internal pressure slightly below atmospheric, [$P_E = -E$]. This lower pressure results in air leakage past the rotor via the body clearance gaps and pumpage through gas lock 61. This air inflow prevents leakage of the buffer seal gas through gas lock 61 in the area external to gas lock 61. In contrast to the inlet gas lock system 20, the discharge gas lock system 25 requires no modulated air and gas bypass compensation valves. This is true because in contrast with the inlet rotary gas lock 36 there is no danger of toxic gases escaping to atmosphere because air tends to flow from the atmosphere into the empty rotor pockets replacing the ash. However, the air into duct 68 is exhausted through pipe 69.

The embodiments of the invention in which an exclusive property or privilege is claimed are defined as follows:

1. An apparatus for providing a continuous feed of coal particles and a seal system for a pressurized process vessel which utilizes heated gas to convert the coal to a process gas; including, first, second and third rotary gas locks interconnected in series relationship and to the pressurized process vessel in series transfer relationship, said first one of said gas locks being arranged to initially receive the coal and the third one of said gas locks being closest to the pressurized process vessel;

means for supplying a buffer seal gas between adjacent second and third rotary gas locks to prevent leakage of gases from the pressurized process vessel through said gas locks into the ambient atmosphere;

means for supplying air to the material outlet side of said first rotary gas lock to replace the voids left by the dumping of the coal particles from the pockets of the first rotary gas lock to prevent the escape of buffer seal gas from the connection between said first and second rotary gas locks into the ambient atmosphere external to the feed system; and means to exhaust gas from between said first and said second rotary gas locks;

whereby the buffer seal gas is prevented from being released to the ambient atmosphere external to the feed and seal system.

2. An apparatus according to claim 1 wherein said rotary gas locks are connected together in series relationship by interposed ducts between adjacent ones of said gas locks; and, said means to apply the buffer seal gas between the two adjacent second and third gas locks is accomplished at the said duct which interconnects the said gas locks.

3. An apparatus according to claim 2 wherein there is provided a screw conveyor connected to receive the coal from the third gas lock of the rotary gas lock feed system and convey the coal into the pressurized process vessel; and, means for providing buffer seal gas between the third gas lock and the screw conveyor to prevent the backflow of hot gas from the pressurized process vessel through the screw conveyor.

4. An apparatus according to claim 1 wherein said means for supplying air to the material outlet side of said first rotary gas lock includes a modulated air flow valve which admits air as compensation air in proportion to the coal solids volume that is dumped from the gas lock pockets.

5. An apparatus according to claim 4 wherein said means for supplying buffer seal gas between the third gas lock and the screw conveyor includes a modulated gas flow valve to provide volumetric buffer seal gas compensation for the material dumped from the pockets of said third gas lock to replace the voids left by the dumping of the coal from the pockets of the third gas lock and thereby prevent process gas from flowing out of the pressurized process vessel through the screw conveyor and the feed system into the ambient atmosphere.

6. An apparatus according to claim 5 wherein there is provided a rotary gas lock discharge system connected to receive the discharge from the pressurized pressure vessel including first, second and third rotary gas locks connected in series relationship, wherein said first gas lock is adjacent the pressurized process vessel and said third gas lock is further from the vessel;

means to supply buffer seal gas between said first and second gas locks closest to the pressurized process vessel to prevent leakage of process gases from the pressurized process vessel through said gas locks; and means to exhaust buffer seal gas between said second and third gas locks which leaks through said second gas lock.

* * * * *